US006147569A

United States Patent [19]

Kishino et al.

[11] Patent Number: 6,147,569

[45] Date of Patent: Nov. 14, 2000

[54] NON-RADIATIVE DIELECTRIC WAVEGUIDE COUPLER

[75] Inventors: Tetsuya Kishino; Takeshi Okamura; Akinori Satoh, all of Kokubu, Japan

[73] Assignee: Kyocera Corporation, Kyoto, Japan

[21] Appl. No.: 09/357,187

[22] Filed: Jul. 20, 1999

[30] Foreign Application Priority Data

Jul. 21, 1998 [JP] Japan ..... 10-205698

[51] Int. Cl.[7] ..... H01P 5/18

[52] U.S. Cl. ..... 333/113; 333/248

[58] Field of Search ..... 333/113, 114, 333/239, 248

[56] References Cited

U.S. PATENT DOCUMENTS 4,091,343 5/1978 Knox et al. ..... 333/113
4,679,011 7/1987 Praba et al. ..... 333/113 X

FOREIGN PATENT DOCUMENTS 731473 6/1955 United Kingdom ..... 333/113

*Primary Examiner*—Paul Gensler
*Attorney, Agent, or Firm*—Hogan & Hartson, LLP

[57] ABSTRACT

A non-radiative dielectric waveguide coupler for coupling or dividing high-frequency signals between at least two dielectric waveguides arranged maintaining a predetermined gap between a pair of parallel flat conductors, wherein said two dielectric waveguides are connected to each other through a bridge of a dielectric material. Upon joining the two dielectric waveguides through the bridge, the gap between the two dielectric waveguides, that affects the characteristics of the coupler, is set maintaining a high precision without effecting any particular positioning operation. Therefore, the coupler can be mass-produced very favorably. Besides, the gap between the two dielectric waveguides is stably maintained without being varied during the production of the coupler or during the use of the coupler, contributing to improving the reliability of the coupler. A drop in the characteristics of the coupler stemming from the provision of the bridge is easily avoided by setting the width of the bridge to be smaller than the width of the dielectric waveguides.

6 Claims, 5 Drawing Sheets

NON-RADIATIVE DIELECTRIC WAVEGUIDE COUPLER

BACKGROUND OF THE INVENTION

1. Field of the Invention

The present invention relates to a non-radiative dielectric waveguide coupler that is incorporated in a circuit such as a millimeter wave integrated circuit to couple and/or divide high-frequency signals among a plurality of non-radiative dielectric waveguides used as a guide for high-frequency signals.

2. Description of the Prior Art

A non-radiative dielectric waveguide transmits high-frequency signals of a wavelength λ by utilizing a dielectric waveguide interposed between parallel flat conductors maintaining a gap z. Upon setting the gap z between the parallel flat conductors to satisfy a relationship $z \leqq \lambda/2$, it becomes possible to transmit signals preventing the infiltration of noise into the dielectric waveguide from the external side and eliminating the radiation of high-frequency signals to the external side.

The non-radiative dielectric waveguide coupler has heretofore been used for dividing and coupling high-frequency signals (electromagnetic waves) and has a structure which is generally as shown in FIG. 8. Referring to FIG. 8, two dielectric waveguides 12 and 13 are arranged between a pair of parallel flat conductors 11*a* and 11*b* (for easy comprehension, the parallel flat conductor 11*a* is represented by a dot-dash chain line). In FIG. 8, the dielectric waveguides 12 and 13 are both formed in a curved shape, and are so arranged that a predetermined gap x is defined at a position where the two dielectric waveguides 12 and 13 become closest to each other.

In the coupler of the above-mentioned constitution, the high-frequency signals input through a port 12*a* of the dielectric waveguide 12 partly transmit through the dielectric waveguide 12 and are output from a port 12*b*, and are partly electromagnetically coupled to the dielectric waveguide 13 at the closest portion and are transmitted toward a port 13*b*. Thus, the signals are output from the port 12*b* of the dielectric waveguide 12 and from the port 13*b* of the dielectric waveguide 13, but are not output from the port 12*a* of the dielectric waveguide 12 or the port 13*a* of the dielectric waveguide 13.

On the other hand, the high-frequency signals input through the port 13*a* of the dielectric waveguide 13 are output from the output port 12*b* of the dielectric waveguide 12 and from the output port 13*b* of the dielectric waveguide 13, but are not output from the port 12*a* of the dielectric waveguide 12 or the port 13*a* of the dielectric waveguide 13.

The high-frequency signals simultaneously input to the ports 12*a* and 13*a* are divided and coupled at a particular ratio, and are output from the ports 12*b* and 13*b*.

In the above-mentioned conventional non-radiative dielectric waveguide coupler, however, the distance x at the closest portion seriously affect the characteristics of the coupler. When the dielectric waveguides 12 and 13 comprise NRD guides having a relative dielectric constant of 5, a width of 1 mm and a height of 2.25 mm, the precision of distance x at the closest portion must be controlled to be not larger than 0.1 mm in order to set the dividing ratio practically required for the ports 12*b* and 13*b* to be 3 dB±1 dB, i.e., to nearly evenly divide the signals. It is very difficult to arrange the two dielectric waveguides 12 and 13 maintaining a high precision between a pair of parallel flat conductors 11*a* and 11*b*, accounting for a major cause that impairs the mass-production. Therefore, the adjustment of positioning during the fabrication drives up the cost of products. There further remains a problem in that the distance x is deviated due to the shock at the time of production or during the use, resulting in a great change in the ratio of division to the ports 12*b* and 13*b*.

SUMMARY OF THE INVENTION

It is therefore an object of the present invention to provide a non-radiative dielectric waveguide coupler that does not require any particular adjustment for the positioning at the time of fabrication, that does not permit the two dielectric waveguides to be deviated irrespective of a shock that may be received during the production or during the use, and that offers advantage in reliability and in mass-productivity.

According to the present invention, there is provided a non-radiative dielectric waveguide coupler for coupling or dividing high-frequency signals between at least two dielectric waveguides arranged maintaining a predetermined gap between a pair of parallel flat conductors, wherein said two dielectric waveguides are connected to each other through a bridge of a dielectric material.

The most important feature in the coupler of the present invention resides in that the two dielectric waveguides are connected together through a bridge of a dielectric material. Use of such a bridge makes it possible to arrange the two dielectric waveguides maintaining a predetermined gap x with high precision without requiring any particular adjustment of the positions, and does not permit the positions of the two dielectric waveguides to be deviated even when a shock is received during the production of the coupler or during the use of the coupler. Therefore, the coupler of the present invention can be mass-produced maintaining a very high reliability.

In the present invention, it is desired that the bridge has a width smaller than that of the dielectric waveguide from the standpoint of decreasing a change in the impedance in the bridge and of decreasing undesired reflection. By decreasing the specific inductive capacity of the bridge to be smaller than that of the dielectric waveguides, furthermore, it is allowed to further decrease the change in the impedance and to further decrease undesired reflection.

The bridge can be provided at plural places. For instance, a pair of bridges can be provided so as to sandwich therebetween the closest portions of the two dielectric waveguides. In this case, the length of the bridges and the length between the pair of bridges along the dielectric waveguides are set to be corresponded to $(2n-1)/4$ (n is an integer) of the wavelength λ of the high-frequency signals. This makes it possible to effectively prevent a drop in the characteristics of the coupler that stems from the provision of the bridges.

DETAILED DESCRIPTION OF THE INVENTION

The invention will now be described in detail by way of concrete examples shown in the accompanying drawings.

Figure 1:
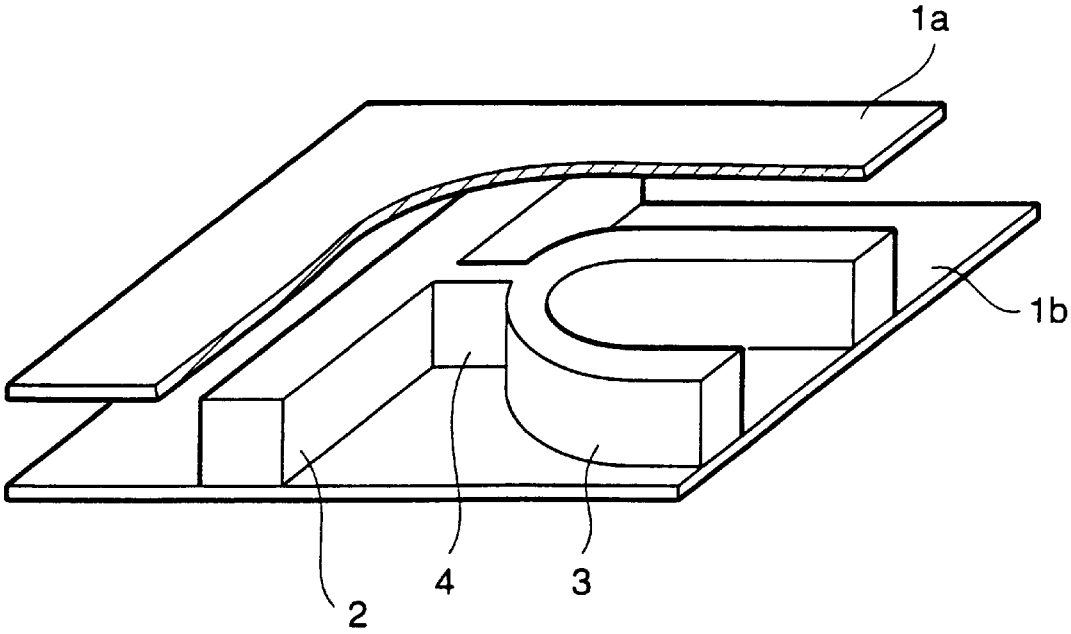
FIG. 1 is a partly cut-away perspective view of a non-radiative dielectric waveguide coupler according to the present invention.
Figure 2:
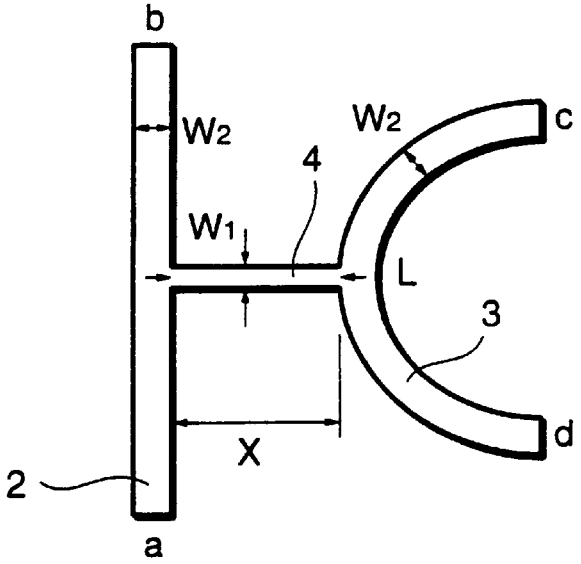
FIG. 2 is a plan view for explaining the waveguide structure of the coupler of FIG. 1.

Referring to FIG. 1 illustrating the non-radiative dielectric waveguide coupler of the present invention and FIG. 2 illustrating the waveguide structure of the coupler of FIG. 1, the coupler includes a first dielectric waveguide 2 and a second dielectric waveguide 3 arranged maintaining a gap x at the closest portion between a pair of parallel flat conductors 1*a* and 1*b*.

The parallel flat conductors 1*a* and 1*b* are formed of conductor plates such as of Cu, Al, Fe, SUS (stainless steel), Ag, Au or Pt, or an insulating material such as ceramic or resin having a conductor layer of these materials formed on the surfaces thereof.

The dielectric waveguides 2 and 3 are formed of a material having a small dielectric loss, i.e., are formed of ceramic such as cordierite, alumina or glass ceramic, or an organic dielectric material or an organic/inorganic composite dielectric material. The first dielectric waveguide 2 and the second dielectric waveguide 3 are formed of substantially the same dielectric material.

In the present invention, the first dielectric waveguide 2 and the second dielectric waveguide 3 are connected together through a bridge 4, whereby the gap (closest distance) x between the two is defined. The bridge 4 is formed of a dielectric material capable of forming dielectric waveguides 2 and 3, such as the above-mentioned ceramics. The bridge is usually formed integrally with the dielectric waveguides 2 and 3. So far as a suitable strength is maintained, however, the bridge 4 may be connected to the dielectric waveguides 2 and 3 with an adhesive such as a resin or a glass.

In the above-mentioned coupler, however, the transmission characteristics may be deteriorated, since the first dielectric waveguide 2 and the second dielectric waveguide 3 are connected together through the bridge 4. That is, the high-frequency signals pass not only through the dielectric waveguides 2 and 3 but also through the bridge 4, whereby the high-frequency signals flowing through the dielectric waveguides 2 and 3 are hindered, and are greatly reflected back to the port a of the first dielectric waveguide 2 and to the port d of the second dielectric waveguide 3; i.e., the transmission characteristics of signals is very decreased toward the port b of the first dielectric waveguide 2 or toward the port c of the second dielectric waveguide 3.

In order to prevent a drop in the signal transmission characteristics according to the present invention, it is desired that the width W1 of the bridge 4 is set to be smaller than the width W2 of the dielectric waveguides 2 and 3, and is, particularly, set to be not larger than 30% of the width W2. Upon forming the bridge 4 in a small width, undesired reflection to the ports a and d is decreased, and the electromagnetic waves propagating through the dielectric waveguides 2 and 3 is little affected by the bridge 4. It is desired that the width W1 of the bridge 4 is not smaller than 0.1 mm from the standpoint of easy production and easy handling maintaining a suitable degree of strength. The length L of the bridge 4 is not smaller than the gap x between the dielectric waveguides 2 and 3. Depending upon the conditions such as frequency, dielectric constants of the dielectric waveguides 2, 3 and of bridge 4, and the width W2 of the waveguides, however, the length L of the bridge 4 is so set that the transmission factors to the ports b and c will assume desired values. In the embodiment of FIGS. 1 and 2, therefore, the bridge 4 is formed at the closest portions of the dielectric waveguides 2 and 3, but may be formed in the vicinity thereof.

In the present invention, furthermore, the relative dielectric constant of the bridge 4 is set to be smaller than that of the dielectric waveguides 2 and 3, in order to further decrease undesired reflection to the ports a and b and to further decrease the effect of the bridge 4 upon the signals propagating through the dielectric waveguides 2 and 3. The relative dielectric constant can be easily adjusted by changing the kind and composition of the dielectric material constituting the dielectric waveguides 2 and 3, and by forming the bridge 4 by using a dielectric material having a relative dielectric constant smaller than that of the above dielectric material.

In the above-mentioned non-radiative dielectric waveguide coupler of the present invention, the dielectric waveguides 2 and 3 are fabricated as a unitary structure through the bridge 4. In arranging this unitary structure between a pair of parallel flat conductors 1*a* and 1*b*, therefore, no operation is required for adjusting the gap x between the waveguides 2 and 3, such as positioning, offering an advantage from the standpoint of mass-production. The high-frequency signals input through the port a of the first dielectric waveguide 2 are divided by the electromagnetic coupling of the first dielectric waveguide 2 and the second dielectric waveguide 3, and are output from the output port b of the first dielectric waveguide 2 and from the output port c of the second dielectric waveguide 3, making it possible to minimize the reflection of signals back to the input port a of the first dielectric waveguide 2 or to the port d of the second dielectric waveguide 3.

Therefore, the coupler of the present invention can be preferably used in a high-frequency band of not lower than 50 GHz, particularly, not lower than 60 GHz and, more particularly, not lower than 70 GHz.

Figure 3:
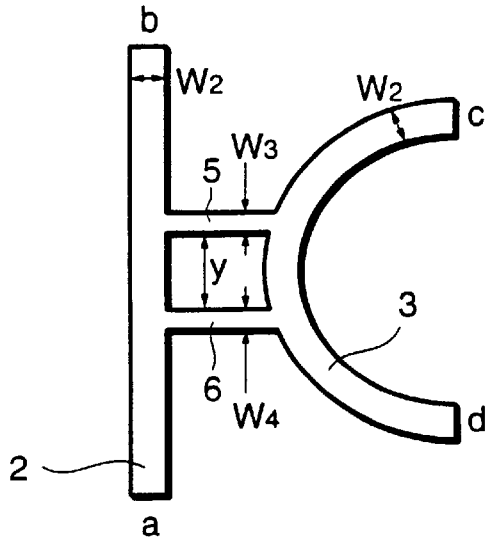
FIGS. 3 and 4 are plan views illustrating other non-radiative dielectric waveguide couplers according to the present invention.
Figure 4:
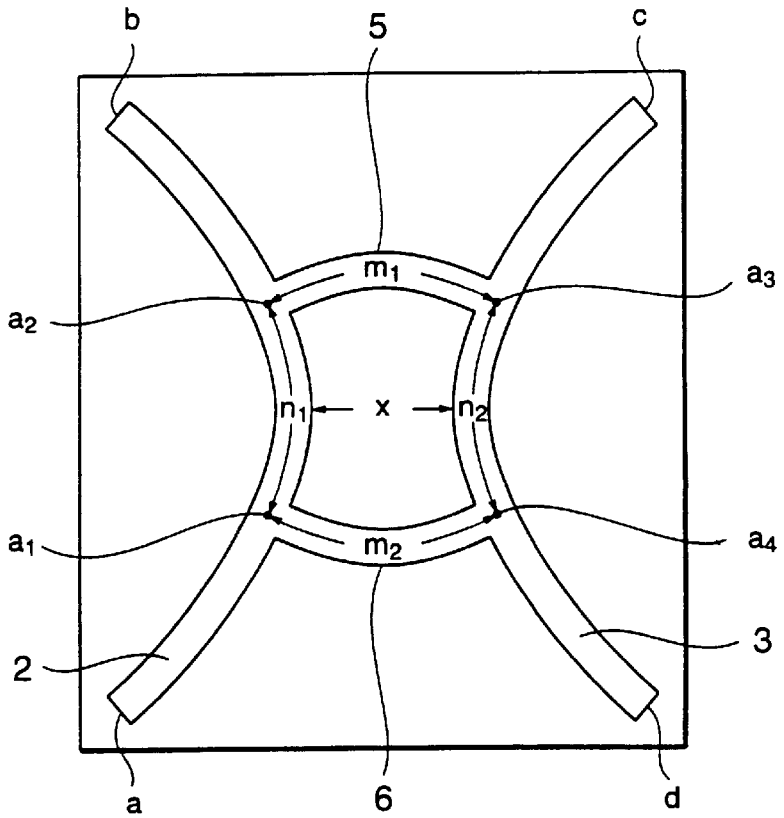

The above-mentioned non-radiative dielectric waveguide coupler of the present invention shown in FIGS. 1 and 2 can be modified in various ways. In order to increase the junction strength, for example, the bridges 4 may be provided in a number of two, three or more. Moreover, the two dielectric waveguides 2 and 3 may be curved or straight. In FIGS. 1 and 2, the bridge 4 is formed straight. The bridge 4, however, may be formed in a curved shape. FIGS. 3 and 4 illustrate examples where a pair of bridges 5 and 6 are formed sandwiching the closest portions of the dielectric waveguides 2 and 3. The coupler of FIG. 3 has the structure substantially the same as that of the coupler of FIGS. 1 and 2 except that straight bridges 5 and 6 are formed. The coupler of FIG. 4 has the structure substantially the same as that of the coupler of FIG. 3 except that the two dielectric waveguides 2 and 3 are curved and that a pair of bridges 5 and 6 are curved. The couplers of FIGS. 3 and 4 have advantages in that they exhibit good mechanical strength and particularly that the ratio for dividing signals to the ports b and c can be easily adjusted. In FIGS. 3 and 4, the pair of parallel flat conductors 1*a* and 1*b* are not shown.

If described with reference to the coupler of FIG. 3, it is desired that the width W3 of the bridge 5 and the width W4 of the bridge 6 are smaller than the width W2 of the dielectric waveguides 2 and 3, and are, particularly, set to be not larger than 30% of the width W2 in order to decrease undesired reflection to the ports a and d. It is further desired that the widths W3 and W4 are not smaller than 0.1 mm from the standpoint of easy production, easy handling and strength.

The widths W3 and W4 of the bridges 5 and 6 need not be equal to each other as far as the above-mentioned conditions are satisfied and undesired reflection back to the ports a and d is decreased. Usually, however, the widths W3 and W4 are set to be as small as possible to minimize the undesired reflection.

By setting the length of the bridges 5 and 6 and the gap y between the bridges to suitable values depending upon the frequency of signals, furthermore, it is allowed to minimize undesired reflection back to the ports a and d. Referring, for example, to the coupler of FIG. 4, it is desired that the lengths m1, m2 of the bridges 5, 6, the distance n1 between the bridges 5 and 6 along the first dielectric waveguide 2, and the distance n2 between the bridges 5 and 6 along the second dielectric waveguide 3, are set to lengths corresponding to $(2n-1)/4$ (n is an integer) of the wavelength $\lambda$ of the high-frequency signals transmitted through the dielectric waveguides 2 and 3. The wavelength of the high-frequency signals stands as a guide wavelength of the NRD guide, and can be found by calculation based on the sectional shape of the dielectric waveguides 2 and 3, dielectric constants and mode.

According to the above-mentioned dimensional adjustment, the high-frequency signals input to the input port a of the first dielectric waveguide 2 are partly reflected at a junction portion a1 to the bridge 6. The reflected signals, however, interfere with the signals reflected at a junction portion a2 to the bridge 5 maintaining a phase difference of ½ wavelength, and are not output to the input port a.

Further, the signals transmitted to the bridge 6 from the junction portion a1 interfere with the signals that have transmitted through the junction portion a2—junction portion a3—dielectric waveguide 3—junction portion a4 maintaining a phase difference of ½ wavelength, and are not output to the input port d of the second dielectric waveguide 3.

On the other hand, the signals that have passed through the junction portion a1 and the signals that have passed through the junction portion a2 are output to the output port b of the first dielectric waveguide 2 in phase with each other and interfering with each other so as to be intensified by each other. Moreover, the signals that have passed through the junction portions a1, a2, a3 and the signals that have passed through the junction portions a1, a4, a3 are output to the output port c of the second dielectric waveguide 3 in phase with each other and interfering with each other so as to be intensified by each other.

By setting the lengths (m1, m2) of the bridges 5 and 6 and the gaps (n1, n2) between the bridges 5 and 6 depending upon the frequency of the signals so as to satisfy the above-mentioned conditions, it is allowed to minimize the undesired reflection back to the ports a and d, to increase the outputs from the ports b and c, and to avoid a drop in the characteristics of the coupler that stems from the provision of the bridges 5 and 6.

In the couplers shown in FIGS. 1 to 4, it is allowable to provide a further dielectric waveguide in addition to the first and second dielectric waveguides 2 and 3, and to join the further dielectric waveguide to the first dielectric waveguide 2 or to the second dielectric waveguide 3. It is thus made possible to join a number of dielectric waveguides like a chain.

The above-mentioned non-radiative dielectric waveguide coupler of the present invention can be produced by a method known per se.

When, for example, the first and second dielectric waveguides and bridges are to be constituted by using dielectric ceramics, a metal mold is prepared to comply with the arrangement of the dielectric waveguides and bridges. Then, the metal mold is filled with a powder of dielectric ceramics and is pressurized to obtain a molded article which is then fired to obtain an integrally molded article of the dielectric waveguides and bridges. It is further possible to obtain an integrally molded article of the dielectric waveguides and bridges by applying a slurry containing a powder of dielectric ceramics onto a predetermined substrate in a pattern corresponding to the arrangement of the dielectric waveguides and bridges, followed by drying and firing. When the dielectric waveguides and bridges are to be constituted by using an organic dielectric material such as a resin or an organic/inorganic composite dielectric material such as a resin/ceramics mixture, an integrally molded article of the dielectric waveguides and bridges is obtained relying on a known method such as injection-molding method, press-molding method or the like method. It is, of course, allowable to obtain an integrated article of the dielectric waveguides and bridges by separately forming the dielectric waveguides and bridges by the above-mentioned method, and firmly adhering the obtained dielectric waveguides and bridges together with an adhesive such as resin or glass.

By arranging the thus obtained integrated article of the dielectric waveguides and bridges between a pair of parallel flat conductors, a coupler of the present invention is obtained without the need of conducting cumbersome operation such as positioning for precisely defining a gap x between the two dielectric waveguides.

EXAMPLES

Experiment 1 (Width of Bridge)

Figure 5:
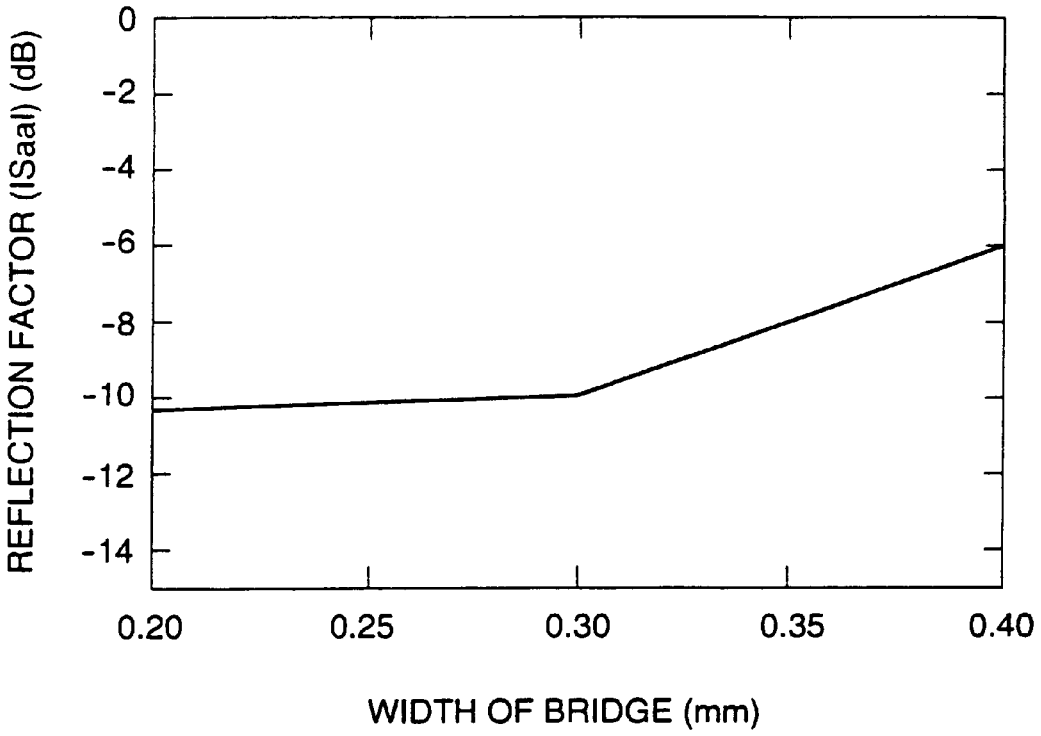
FIG. 5 is a diagram illustrating a relationship between the width of the bridge and the reflection factor ($|Saa|$) of the coupler of FIG. 1.

Using cordierite having a relative dielectric constant of 5 and a dielectric loss of $3\times10^{-4}$ (as measured at a frequency of 60 GHz), integrally sintered products which are composed of two dielectric waveguides and one bridge having a varing width W1, were prepared by integrally firing the cordierite. The dielectric waveguides have a width W2 of 1.0 mm and a height of 2.25 mm in cross section, one of the waveguides is straight and the other one of the waveguides is curved (radius of curvature of 3.9 mm at the closest portion). The bridge has a length of 1.5 mm and a height of 2.25 mm, and is arranged between the two waveguides at the closest portion. The integrally sintered product was arranged between a pair of parallel flat conductors of copper to obtain a coupler having a structure as shown in FIGS. 1 and 2, and its high-frequency transmission characteristics were evaluated. FIG. 5 illustrates a relationship between the width W1 of the bridge and the reflection factor (|Saa|) at the port a at 60 GHz.

As will be clear from the results of FIG. 5, the reflection factor decreases with a decrease in the width of the bridge and, particularly, the reflection factor becomes smaller than −10 dB when the width of the bridge is not larger than 0.30 mm (30% of the width of the dielectric waveguides).

Figure 6:
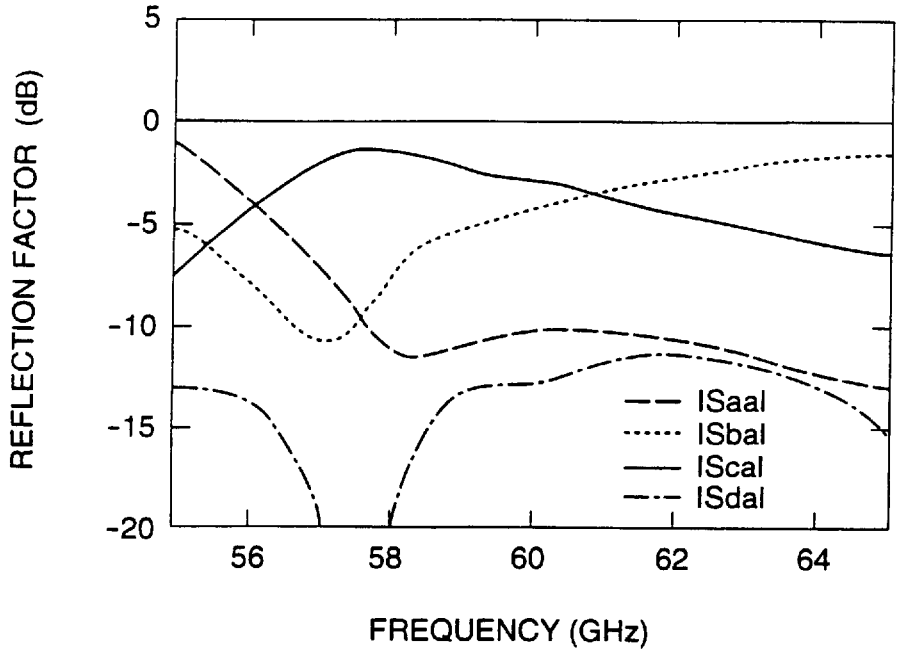
FIG. 6 is a diagram illustrating high-frequency transmission characteristics of the coupler of FIG. 1.

FIG. 6 shows changes in the reflection factors |Saa|, |Sba|, |Sca| and |Sda| at the ports a, b, c and d relying upon a change in the frequency of when the bridge has a width of 0.20 mm.

As will be clear from the results of FIG. 6, the reflection factors |Saa| and |Sda| are sufficiently small in a frequency band of not lower than 58 GHz, and good coupler characteristics are obtained in this frequency band.

Experiment 2 (Distance y between the Bridges)

Figure 7:
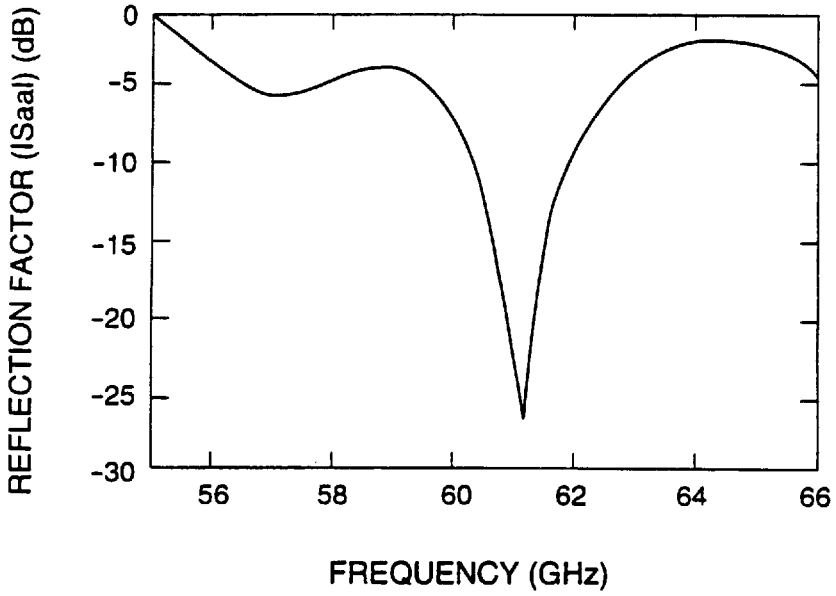
FIG. 7 is a diagram illustrating high-frequency transmission characteristics of the coupler of FIG. 3.
Figure 8:
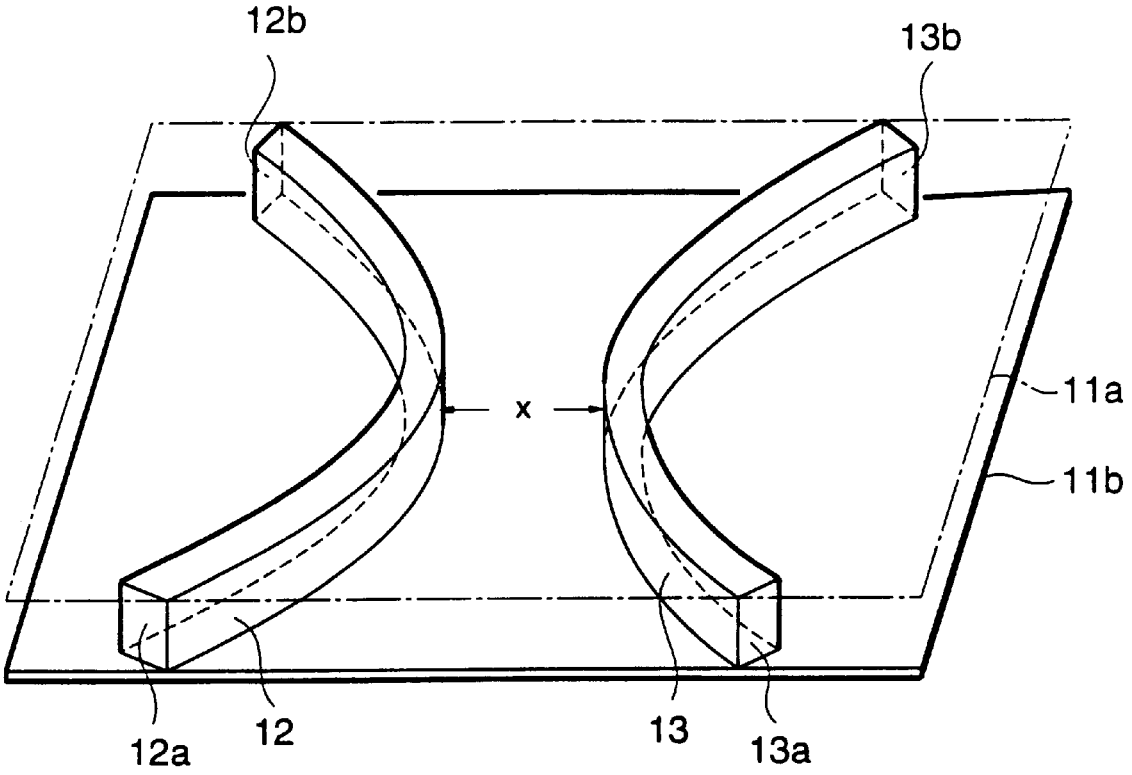
FIG.8 PRIOR ART
FIG. 8 is a perspective view schematically illustrating a widely known non-radiative dielectric waveguide coupler.

A coupler shown in FIG. 3 was prepared in the same manner as in Experiment 1 but arranging two bridges having a length of 2 mm on both sides of the closest portions of the two dielectric waveguides maintaining a distance of 4 mm, and was evaluated for its characteristics in the same manner as described above. FIG. 7 shows a change in the reflection factor (|Saa|) at the port a with a change in the frequency.

As will be clear from the results of FIG. 7, the reflection factor (|Saa|) decreases near 61 GHz, and good coupler characteristics are exhibited in this frequency band.

What is claimed is:

1. A non-radiative dielectric waveguide coupler for coupling or dividing high-frequency signals between at least two-dielectric waveguides arranged maintaining a predetermined gap between a pair of parallel flat conductors, wherein said two dielectric waveguides are connected to each other through at least one bridge of a dielectric material.

2. A non-radiative dielectric waveguide coupler according to claim 1, wherein said at least one bridge has a width smaller than that of the dielectric waveguides.

3. A non-radiative dielectric waveguide coupler according to claim 1, wherein said at least one bridge has a relative dielectric constant smaller than that of said dielectric waveguides.

4. A non-radiative dielectric waveguide coupler according to claim 1, wherein said at least one bridge is formed integrally with the dielectric waveguides.

5. A non-radiative dielectric waveguide coupler according to claim 1, wherein said at least one bridge is a pair of bridges so as to sandwich therebetween the closest portions of the two dielectric waveguides.

6. A non-radiative dielectric waveguide coupler according to claim 5, wherein the length of each bridge and the length between the pair of bridges along the dielectric waveguides are set to be corresponded to $(2n-1)/4$ of the wavelength $\lambda$ of the high-frequency signals wherein n is an integer.

* * * * *